United States Patent [19]

Sumitomo

[11] 4,282,911

[45] Aug. 11, 1981

[54] COMBINED HANGER AND BAG FOR A HANGER BAG

[75] Inventor: Kojiro Sumitomo, Taipei, Taiwan

[73] Assignee: Sanyei Corporation, Japan

[21] Appl. No.: 128,392

[22] Filed: Mar. 10, 1980

[51] Int. Cl.[3] ..... A45C 11/00; B65D 85/18

[52] U.S. Cl. ..... 150/1; 190/43; 223/98; 248/100

[58] Field of Search ..... 150/1, 1.8; 190/43; 229/63; 223/49, 98; 248/94, 95, 99, 100, 101

[56] References Cited

U.S. PATENT DOCUMENTS

| | | | |
|---|---|---|---|
| 2,710,732 | 6/1955 | Peters | 248/100 |
| 2,895,521 | 7/1959 | Weber | 150/1 |
| 3,222,019 | 12/1965 | Weisberg | 248/100 |
| 3,733,016 | 5/1973 | Rood | 223/98 |
| 3,834,497 | 9/1974 | Furst | 150/1 |
| 3,934,631 | 1/1976 | Wilson | 150/1 |
| 4,223,858 | 9/1980 | De Salazcer | 248/101 |

*Primary Examiner*—Herbert F. Ross

*Attorney, Agent, or Firm*—Ostrolenk, Faber, Gerb & Soffen

[57] ABSTRACT

A combined hanger and bag. The hanger is substantially triangular and comprises congruent parallel frame members with snap extensions on one member and corresponding openings on the other member so that the two members may be snapped together. A hook is provided for suspending the hanger by one of the frame members. A bag having a corresponding triangular opening is provided with reinforcements having bag openings which may be engaged by the extensions of the frame member which carries the snap extensions. The reinforcing members are also provided with longitudinal beads which are received in recesses located inwardly of the extension. The lower run of the hanger receives a reinforcement that extends directly upwardly from the bag. The other two reinforcements are folded over the outside of the frame which carries the snap extensions so that the openings engage the snap extensions and the longitudinal reinforcement bead engages the recess inwardly of the snap extensions.

7 Claims, 6 Drawing Figures

COMBINED HANGER AND BAG FOR A HANGER BAG

The present invention relates to a hanger bag and more particularly to a bag adapted to be hung on and integrated with a hanger while it is hung. The bag is so arranged that its mouth will be held open while it is hanging so that clothing, or the like, may readily be placed therein. The bag is also so arranged that it may be detached from the hanger for closure of the bag and for carrying the bag apart from the hanger.

BACKGROUND OF THE INVENTION

Many attempts have been made to provide a simplified bag hanging apparatus which will readily hold and secure a bag so that its top is open for receiving objects while the bag is on a hanger and which permits the bag to be readily removed from the hanger. At the same time, the hanger is to provide a spreader for holding the mouth of the bag open for receiving articles. Such attempts are shown in prior U.S. Pat. Nos. to Wilson, 3,934,631; Salisbury, 1,476,423; Born, 1,190,094; and Lindquist, 3,027,065. However, various problems have arisen both in the utilization and structure of the bag and hanger.

SUMMARY OF THE INVENTION

The present invention combines a bag and a hanger, wherein the hanger spreads the mouth of the bag and supports the bag so that the bag may be hung in a closet or in any other suitable place to receive articles, such as laundry.

The hanger is comprised of a compound hanger frame comprising two parallel frame elements arranged congruently so that the frame elements may capture the lip of the bag between them and thereby retain the mouth of the bag in open position conforming to the shape of the hanger until the bag is removed from the hanger. Although the hanger may be of any desired shape, it preferably is triangular so that it will match and not be out of place with other hangers in a closet. At the minimum, the hanger frame has a bottom or horizontal run and an upwardly inclined run that intersects the bottom run and is in a common plane with it. The hanger, of course, is provided with a suspension hook.

The top opening of the bag may be so formed so that it conforms to the shape of the hanger, i.e. for a triangular hanger, the bag opening is correspondingly triangular.

The invention contemplates that the two elements of the hanger may be secured, e.g. by being snapped together, and that they provide detents or other holding means which not only snap the two hanger frame elements together but also capture the lip of the bag between them.

The lip of the bag is provided with reinforcements that are secured between the frame elements. The reinforcements at other than the bottom run of the frame are folded over one of the frame elements on the respective frame run and are then secured between the frame elements. In addition, appropriate beads on the reinforcements are received in respective recesses in the frame elements.

The primary object of the present invention is to provide an effective hanger bag.

Another object of the invention is to effectively secure a bag to the hanger therefor.

A further object of the present invention is to facilitate the removal of the bag from the hanger, for example so that the bag may be closed or carried apart from the hanger.

BRIEF DESCRIPTION OF THE DRAWINGS

The foregoing and other objects and features of the present invention will become apparent in the following description and accompanying drawings in which.

DESCRIPTION OF A PREFERRED EMBODIMENT

Referring to the Figures, the novel hanger bag comprises the bag 10 and the hanger 11.

Figure 1:
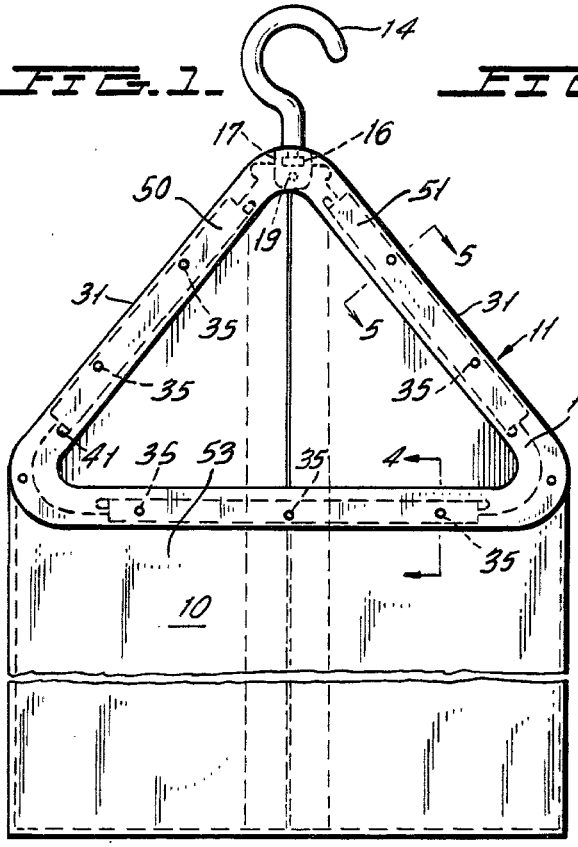
FIG. 1 is a front elevation of the combined bag and hanger.
Figure 2:
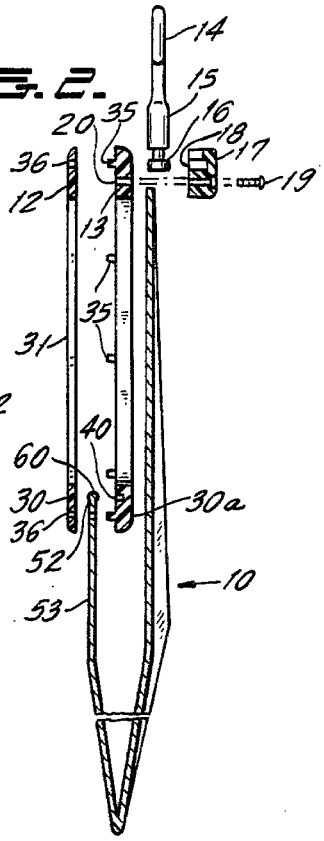
FIG. 2 is a vertical cross-sectional view taken down the center line of FIG. 1.

The hanger 11 is constructed of two congruent, parallel sections 12 and 13, as seen in FIG. 2. The two sections 12 and 13 may be triangular in shape. They are parallel to and match each other and may be placed in surface-to-surface relation with respect to each other.

One of the sections of the hanger such as section 13 may be provided with a hook 14 which may be secured thereto in any suitable manner. One such method of securement is shown in FIG. 2 wherein the hook 14 is provided with an extension 15 terminating in a plug 16. A support member 17 having a recess 18 to receive the plug 16 may be secured in any suitable manner, as, for instance, by the screw 19, into the opening 20 at the apex of section 13 in order to integrate the members 17, 16, 20 and 13 together so that the hook is fully secured. It will be obvious here that the hook may thus readily be not only secured but may be readily removed, if desired, by removal of the screw 19. Where removability of the hook is not desired, then the hook 14 and its post 15 may be made integral with the hanger frame section 13.

Figure 6:
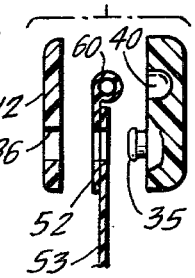
FIG. 6 is a cross-sectional view corresponding to FIG. 4 showing how the parts may be snapped together.

The hanger frame sections 13 and 12 each have a respective horizontal or bottom run 30, **30*a*, and a respective pair of inclined runs 31, 31*a* which extend up from the bottom run. All runs of each frame section are in a common plane. The two inclined runs 31*a* of the hanger section 13 are provided with snap extensions 35, seen more particularly in FIGS. 4, 5 and 6. The snap extensions 35 are so that when the two hanger sections 12 and 13 are placed together, the snap extensions 35 will snap into correspondingly placed and shaped openings 36 of the hanger section 12 and be removably integrated therewith, so that the extensions 35 and openings 36 will be frictionally snapped together. When the seam between the two hanger sections 12 and 13 is pried apart by a finger pulling on the section 12, the two sections 12 and 13 may be separated. For all practical purposes, however, and for any vertically disposed weight hanging therefrom, the two sections will stay together since the force exerted by any bag held by them is vertical rather than in a direction along the general axis of the snap extension 35**.

The section 13 of the hanger, which carries the studs or snap extensions 35, is provided with a plurality of recesses 40 and 41. The recess 40 extends in the lower horizontal run 30*a* of the hanger section 13. The recesses 41 extend in the inclined runs 31*a* of the hanger section 13.

The bag 10 is provided at its upper lip with a generally triangular open structure to match the hanger frame section 13 of the hanger 11 and is provided with reinforcements 50, 51 and 52, one along each of the triangular sides of the opening in the bag. The reinforcements are all brought to the outside of the hanger 11, and the reinforcements 50 and 51 are then folded inward around the upper, inclined respective runs of the hanger.

Figure 3:
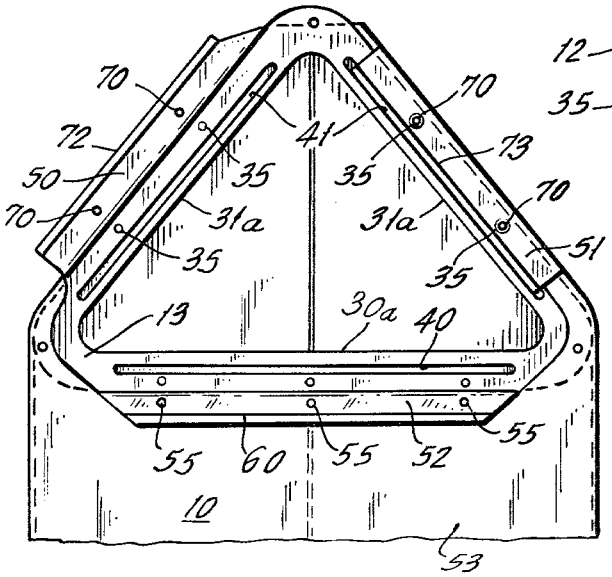
FIG. 3 is a view corresponding to that of FIG. 1 showing one of the elements of the hanger removed so that the bag may be removed therefrom.

In contrast, the reinforcement 52 of the bag is a direct vertical extension atop the front wall 53 of the bag 10, as seen particularly in FIG. 2 and in FIG. 3. Reinforcement 52 is provided with openings 55 which are aligned with the corresponding openings 36 in the bottom run 30*a* of the hanger, whereby when the bag 10 is placed at the hanger 11 and the reinforcement 52 is placed on the hanger run 30*a*, the openings 55 may receive the snap extensions 35 so that the reinforcement 52 will be mounted to the hanger. Thus, when the sections 12 and 13 of the hanger 11 are placed together and run 30*a* of the frame section 13 is engaged with the run 30 of the frame section 12, the snap extensions 35 pass through the openings 36 of the frame 12 and also through the openings 55 in the reinforcement extension 52 of the bag wall 53.

The reinforcement 52 is provided with an edge bead 60 which is received in the recess 40 of the lower horizontal run 30 of the frame 13 thereby further integrating the bag with the frame and ensuring that the bag could not be pulled out. The spacing between the bead 60 and the openings 55 assures each can be at its desired location.

Figure 5:
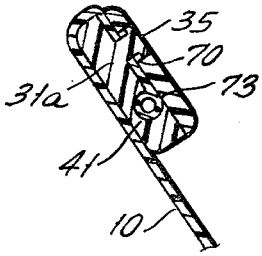
FIG. 5 is a cross-sectional view taken on line 5—5 of FIG. 1 looking in the direction of the arrows.

The reinforcements 50, 51 of the bag 10 engage the inclined runs 31*a* of the frame section 13 of the hanger, as shown in FIGS. 3 and 5. The reinforcements 50, 51 are extensions of the bags which are folded inwardly over the outside of the runs 31*a* so that the openings 70 through the reinforcements overlie the openings 36 in the inclined runs 31*a* of the frame section 13 and can thereby receive the snap extensions 35 from the runs 31*a*. The invention will effectively operate if the bag is passed up outside the runs 31 of the frame section 12 and are then folded inwardly over these runs and between the frame sections.

The reinforcements 50, 51 by thus being folded over, obtain further support for the bag along the inclined runs of the hanger. In addition, the bead 72 on reinforcement 50 and the bead 73 on reinforcement 51 of the bag are received in the respective recesses 41 of the two inclined runs 31*a*, 31*a* of the frame section 13 of the hanger to further secure the bag to the hanger. The recesses 41 are inward with respect to the hanger, relative to the extensions 35 with which they cooperate. Although the reinforcement 52 is not folded, the respective recess is still inward of the extensions as the bead on the reinforcement 52 is further out along the reinforcement from the extensions.

Figure 4:
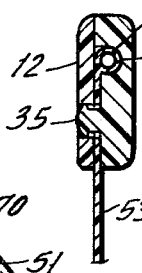
FIG. 4 is a cross-sectional view taken on line 4—4 of FIG. 1 looking in the direction of the arrows.

When the other parallel and congruent section 12 of the hanger frame is snapped onto the snap extensions 35, as shown in the cross-sectional views of FIGS. 4 and 5, the bag is held in position not only by the snap extensions 35 going through the holes in the reinforcements 50, 51 of the bag, but also by the beads 72 and 73 being captured in the respective recesses 41 and by the bead 60 of the reinforcement 52 being captured in the recess 40.

Although the bag 10 is thus easily and firmly secured to the hanger, it may readily be separated from the hanger, simply by pulling the frame section 12 away from the frame section 13 in a direction substantially along the axis of the snap extensions 35.

Securement of the bag to the hanger is obtained by the folding of the reinforcements 50 and 51 over the inclined runs 31*a*, of the frame section 13, by the capture of all three sides of the entrance portion of the bag between the two frame sections 12 and 13, by the passing of the snap extensions 35 through the openings in the reinforcements at the upper portion of the bag further by the engagement of beads at the longitudinal ends of the reinforcements into corresponding recesses in the frame section 13 and by the maintenance of that engagement by the securement of the hanger frame section 12 to the section 13. The bag cannot be accidentally removed from the hanger.

The only way of removing the bag from the hanger is by pulling the frame section 12 away from the frame section 13 along the direction of the axes of the studs 35. This will permit unfolding of the members 50, 51 from the upper runs 31*a* of the frame section 13 and the pulling out of the reinforcement 52 from its engagement with the recess 40 of the horizontal run 30*a* of the frame section 13.

In the foregoing, the present invention has been described solely in connection with a preferred illustrative embodiment thereof. Since many variations and modifications will now be obvious to those skilled in the art, it is preferred that the scope of this invention be determined not by the specific disclosure herein contained but only by the appended claims.

What is claimed is:

1. A combined hanger and bag, comprising: a hanger comprised of a frame having a bottom run and at least one run extending upwardly from said bottom run and in a common plane therewith; said hanger frame comprising a pair of parallel and congruent sections, with one said section being a principal support section and the other said section being a securement section; said principal support section having a plurality of extensions extending therefrom; said securement section having a plurality of corresponding openings for securely receiving and holding said extensions in said openings when said two sections are placed together;

a bag having an open upper end; a plurality of openings formed in said upper end of said bag; said bag openings each corresponding to the position of a said extension on said main support section; said bag being placed such that the portions thereof including said bag openings is placed between said hanger frame sections; said extensions passing through said bag openings when said sections are placed together;

said hanger also including suspension means for suspending said hanger.

2. The combined hanger and bag of claim 1, wherein said upper end of said bag is provided with reinforcements; at least one of said reinforcements corresponds to said horizontal run and one of said reinforcements corresponds to said upwardly extending run of said hanger; said bag openings being placed in said reinforcements.

3. The combined hanger and bag of claim 2, wherein said reinforcements are also provided with longitudinal beads; said frame member sections each having a recess defined in the surface thereof that faces toward the other of said frame member sections; said recess being adapted to receive and retain a respective said bead; said beads being retained in position by the respective said recesses.

4. The combined hanger and bag of claim 3, wherein the said reinforcement for the part of said bag received by said upwardly extending runs of said hanger are folded over the outside of one of said frame member sections and extends between said sections so that the openings in said reinforcements engage said extensions.

5. The combined hanger and bag of claim 4, wherein the respective said longitudinal recess of a said run is placed inwardly of said extensions and generally parallel to the line of said extensions for receiving said longitudinal bead.

6. The combined hanger and bag of claim 4, wherein the shape of both said frame member sections is triangular including two said upwardly extending runs, said longitudinal recesses on each said run of the said frame member section carrying said extensions are all placed inwardly, with respect to the periphery of said hanger, of said extensions.

7. The combined hanger and bag of claim 6 wherein said suspension means comprises a hanging hook and means for securing said hook to said frame member.

* * * * *